US009987758B2

(12) United States Patent
Levine et al.

(10) Patent No.: US 9,987,758 B2
(45) Date of Patent: Jun. 5, 2018

(54) PROTECTIVE WEAPON

(71) Applicant: ALBL LLC, Gaithersburg, MD (US)

(72) Inventors: Jeffrey C. Levine, North Potomac, MD (US); Joshua D. Levine, North Potomac, MD (US); Evan M. Levine, North Potomac, MD (US)

(73) Assignee: ALBL LLC, Gaithersburg, MD (US)

( * ) Notice: Subject to any disclaimer, the term of this patent is extended or adjusted under 35 U.S.C. 154(b) by 113 days.

(21) Appl. No.: 14/120,552

(22) Filed: Jun. 4, 2014

(65) Prior Publication Data

US 2015/0352732 A1 Dec. 10, 2015

(51) Int. Cl.

| | |
|---|---|
| ***B26B 1/08*** | (2006.01) |
| ***B41B 13/00*** | (2006.01) |
| ***F41B 13/00*** | (2006.01) |

(52) U.S. Cl.

CPC ..... *B26B 1/08* (2013.01); *F41B 13/00* (2013.01); *Y10T 29/49828* (2015.01)

(58) Field of Classification Search

CPC .. B26B 1/00; F41B 15/00; F41B 15/08; F41B 15/06; F41B 15/10; F41B 15/02

USPC ..... 30/162

See application file for complete search history.

(56) References Cited

U.S. PATENT DOCUMENTS

| | | | | | |
|---|---|---|---|---|---|
| 2,099,447 | A * | 11/1937 | Matsuyama | F41B 15/06 | 463/47.4 |
| 2,741,025 | A * | 4/1956 | Stewart | F41B 15/06 | 30/151 |
| 2,845,659 | A * | 8/1958 | Osborne | C08J 9/30 | 264/50 |
| 4,096,629 | A * | 6/1978 | Levine | B26B 1/00 | 30/152 |
| 6,122,828 | A * | 9/2000 | Asterino, Jr. | B26B 3/06 | 30/151 |
| D500,546 | S * | 1/2005 | Anderson | D22/117 | |
| D510,121 | S * | 9/2005 | Blair | D22/117 | |
| D528,893 | S * | 9/2006 | Budd | D22/118 | |
| 2003/0061714 | A1* | 4/2003 | Pope | B24D 15/084 | 30/138 |
| 2010/0236077 | A1* | 9/2010 | Shirey | B26B 1/02 | 30/152 |

* cited by examiner

*Primary Examiner* — Jonathan Riley
(74) *Attorney, Agent, or Firm* — NovaTechIP International PLLC

(57) ABSTRACT

A self-defense weapon for women and others, comprising a lightweight, portable single or multi-bladed weapon adapted to be held in the hand and when activated by squeezing, one or more blades are exposed outwardly between the fingers. When the hand is relaxed, the weapon is deactivated, and the blades retract into the body of the weapon (sheath) protecting the user, so the weapon may be safely carried in the user's pocket or purse.

20 Claims, 5 Drawing Sheets

PROTECTIVE WEAPON

STATEMENT OF INVENTION

This invention generally relates to portable self-defense weapons for women and others, and is particularly concerned with a single or multi-bladed weapon that is easily and rapidly employed to fend off an attacker.

BACKGROUND

Animals and birds have sharp claws to both attack and defend against predatory animals for survival. Without these natural assets, women need a similar artificial weapon to fend off predators.

In the past many non-conventional knives and blades have been proposed for different purposes that are carried or supported by the human hand, with many being used for cutting, scraping, tearing, or penetrating.

For example, multiple fixed bladed weapons attached to handles, in which the blades are continuously exposed, have been available for many years. In another example, a multi-bladed weapon is disclosed in U.S. Pat. No. 4,096,629 A whereby the blades are not continuously exposed, but stored in the handle, and activated by a mechanical mechanism to project and retract the blades back into the handle upon operation by the user.

SUMMARY OF THE INVENTION

The present invention provides for a small, portable, lightweight, easy to use single or multi-bladed weapon that can be carried and safely stored by the user, yet rapidly activated when needed to repel an assault. Unlike earlier patents, the blade or blades are fixed length and not moveable, and a retractable protective means normally isolates the blades in the body of the weapon to protect the user when not activated. To activate, the user squeezes the weapon, the retractable protective spring means constricts, and exposes the fixed length blade or blades for use against an attacker. When the user relaxes their grip, the retractable protective spring means expands to again sheathe the blade or blades in the body of the weapon and protect the user from the blades.

This weapon may be similar in appearance and function to animal claws or talons, or pointed cutting blades, and used the same way animals do to repel attacks, or may be a penetrative blade for use against predators. This single or multi-bladed weapon is hand held, lightweight, portable and when squeezed, constricts the compressible spring means resulting in the cutting or stabbing end of the blades protruding between and beyond the users fingers, and used in a "cutting, slashing or penetrating" action as the blades are applied against the body of the attacker. Although no special skills, training, or strength is required on the part of the user, the device is highly effective.

In preferred embodiments, the blade or blades are small, spaced apart in parallel according to the width of the fingers, and normally contained or sheathed within the retractable protective spring means and rigid upper member designed to sheathe the blades, guide the blades during use, and provide structural rigidity. This retractable protective spring means automatically expands when the weapon is not in use, to sheathe the blade or blades and safely carry the device in the hand, pocket, or purse, without danger to the user. In use, the person squeezes the weapon, which constricts the retractable protective spring means, exposing the cuffing or penetrating edges of the blades. This weapon is designed to be small, portable, lightweight, easy to use and functional for defense when needed. Unlike earlier patents, the blades are fixed length, movable only with respect to the users hand, and only exposed for use when the user squeezes the retractable protective spring means to expose the blade or blades, as a claw or penetrating weapon.

This weapon may have a strap means attached to the rigid upper portion, rigid lower portion or both, that fastens around the outside of the users hand and is expandable to fit most users hands. The strap means may be expandable material or two separate straps attachable by attachment means such as snaps, Velcro, or other materials. The strap means will prevent the user from inadvertently dropping the weapon or having it removed by the attacker during use.

DETAILED DESCRIPTION OF PREFERRED EMBODIMENT

Figure 1:
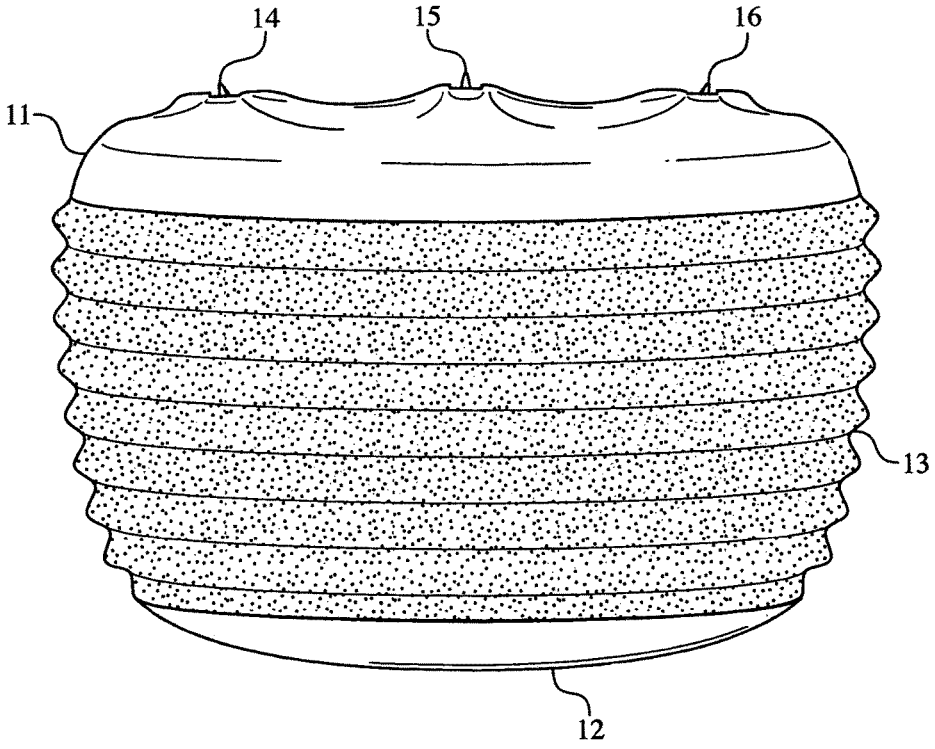
FIG. 1 is a perspective view of the preferred embodiment when the weapon is in a relaxed mode and not in use.
Figure 2:
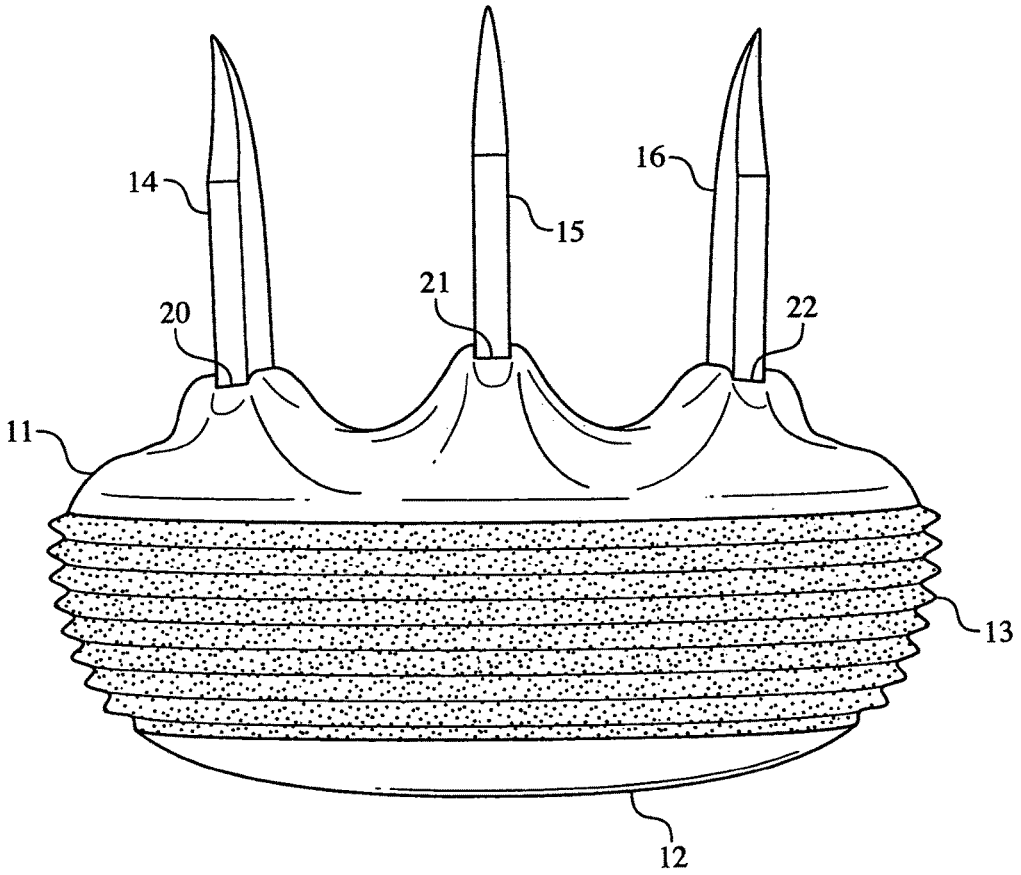
FIG. 2 is a perspective view of the preferred embodiment when the weapon is compressed and ready for use.
Figure 3:
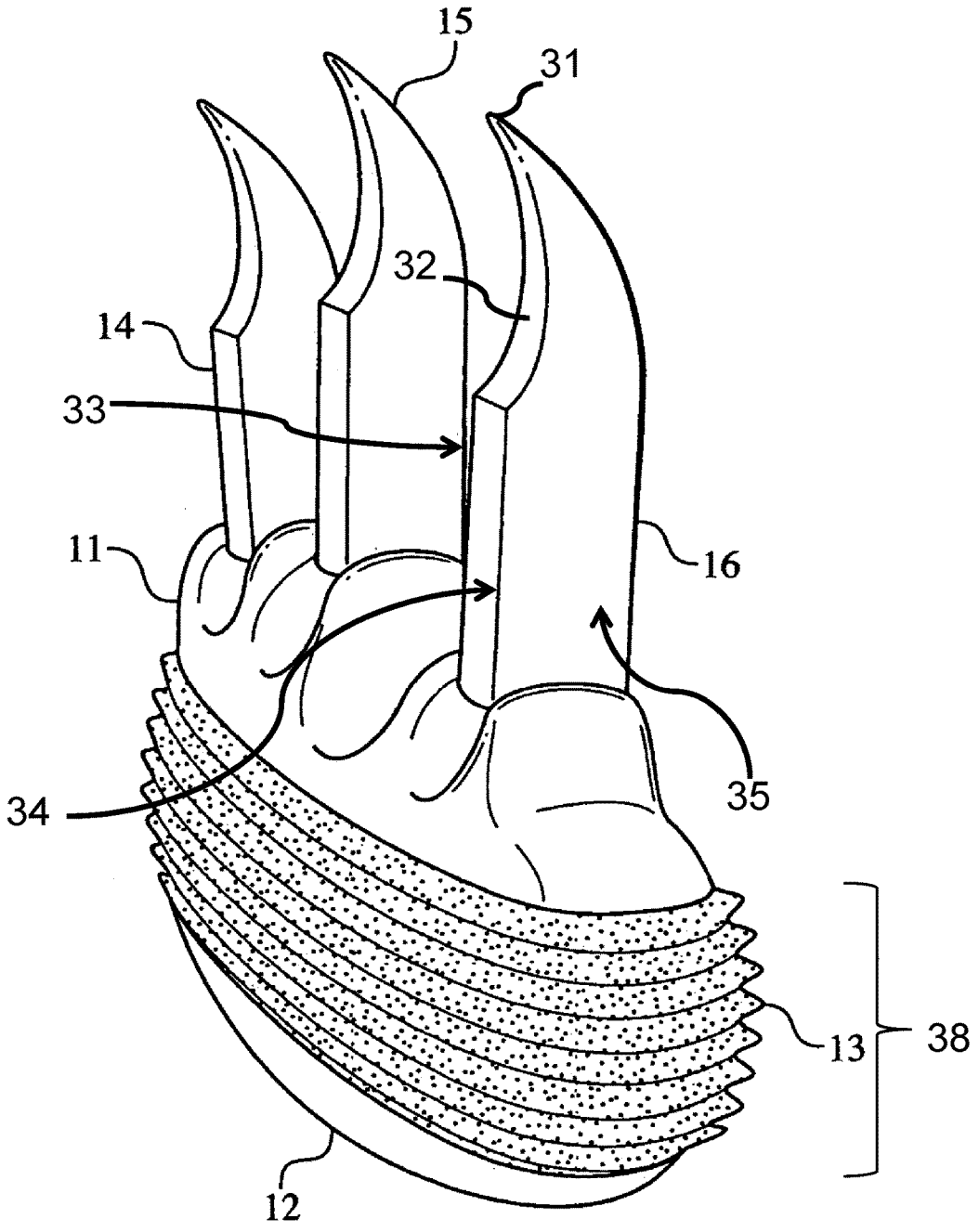
FIG. 3 is a cross sectional view of FIG. 2 when the weapon is compressed and ready for use.
Figure 4:
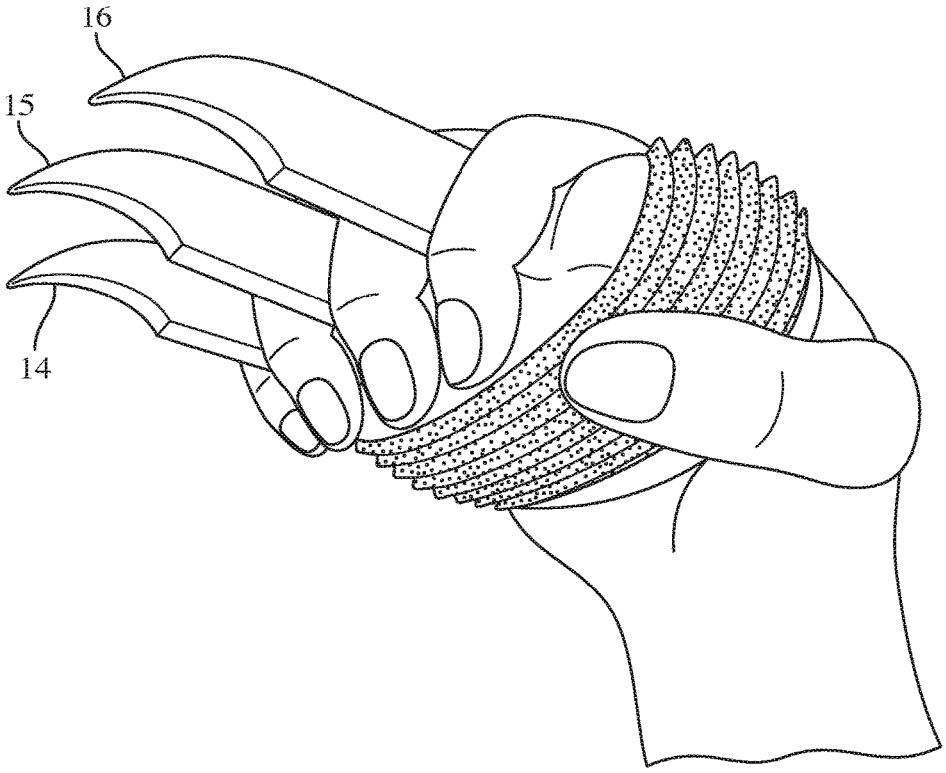
FIG. 4 is a cross sectional view of FIG. 3, when compressed by the human hand, with blades exposed and ready for use.
Figure 5:
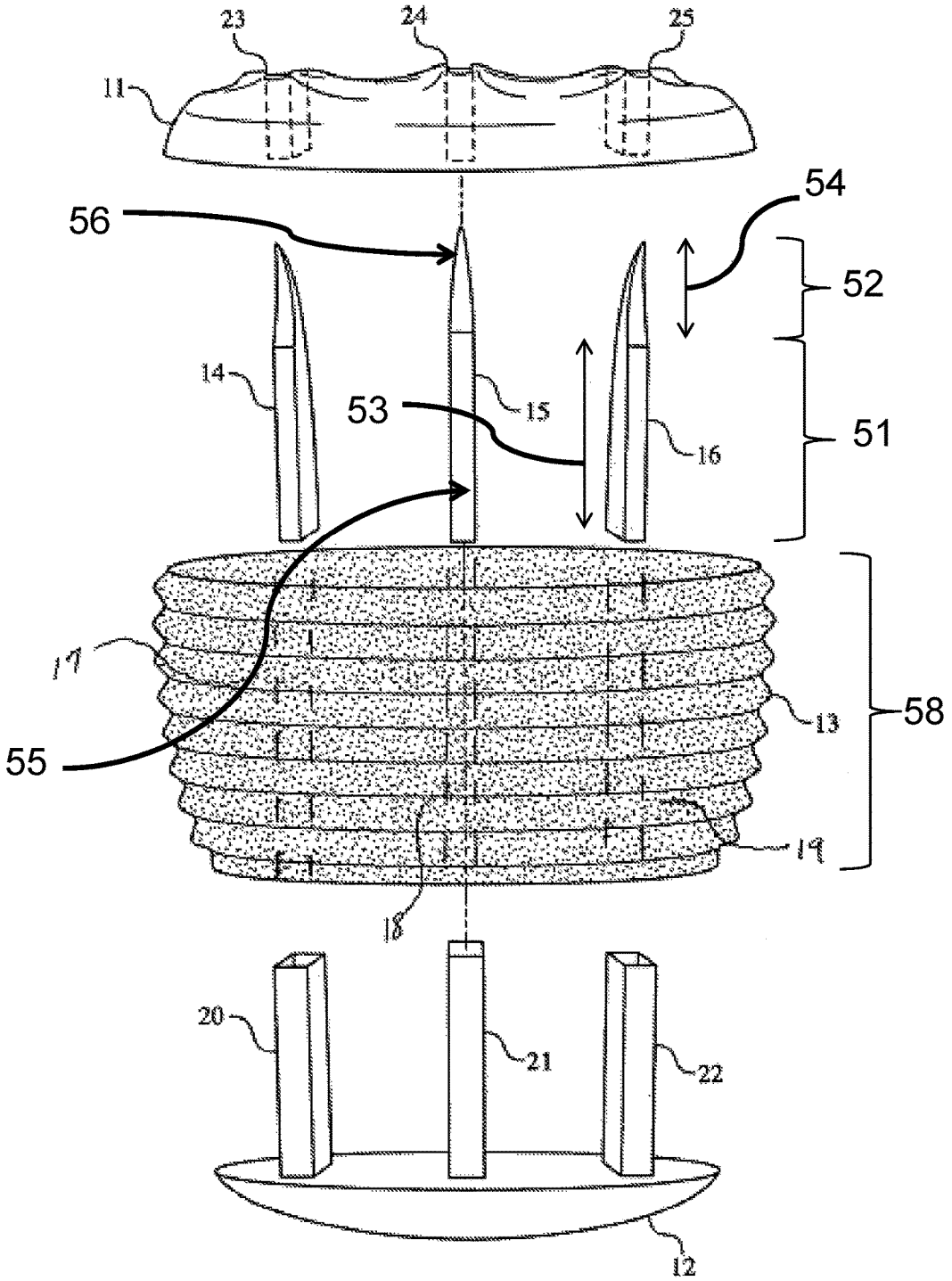
FIG. 5 is an exploded view of the component parts of the weapon prior to assembly.

In FIG. 1, a deactivated state of the weapon is shown, while in FIGS. 2-4, the weapon is in an activated state. Referring to FIGS. 2-5, it can be seen that the weapon includes a first blade 14, a second blade 15, and a third blade 16, which may collectively be referred to as blades 14, 15, and 16. In one implementation, the blades 14, 15, and 16 are disposed in a substantially parallel arrangement. Each blade comprises an upper portion extending from an elongated body portion. For example, in FIG. 5, the third blade 16 includes a body portion 51 and an upper portion 52. Furthermore, it can be seen that the body portion 51 includes a first length 53, and the upper portion 52 includes a second length 54, and that the first length 53 is greater than the second length 54. The body portion 51 can be substantially blunt in some implementations. As shown in FIG. 3, for purposes of reference, the body portion includes a forward-facing surface ("forward surface") 34, a first side surface 33, and a second side surface 35. The forward surface 34 extends between the first side surface 33 and the second side surface 35. In some implementations, the forward surface 34 is substantially blunt, smooth, and/or flat or planar. In one implementation, the forward surface 34 has a substantially rectangular shape, as shown in FIG. 5. Similarly, the first side surface 33 and/or the second side surface 35 can also be substantially blunt, smooth and/or flat or planar in some implementations, as shown in FIG. 3. The body portion 51 can be understood to include a greater thickness than the upper portion 52 in some implementations. In addition, it can be seen that the upper portion 52 includes a concave surface 32 that extends from the forward surface 34 to an outermost tip portion 31. The concave surface 32 curves inward relative to the forward surface 34 and terminates at a sharp pointed end on the outermost tip portion 52. The forward surface 34 can also be understood to include a first width 55, while the concave surface 32 includes a second width 56, and the first width 55 is greater than the second width 56. In some implementations, the concave surface 32 tapers in width as it approaches the outermost tip portion 52. In addition, the blades 14, 15, and 16 are disposed or secured within a sheath casing, where the sheath includes a flexible and compressible housing portion (identified as semi-rigid material 13 in the figures) that extends between a rigid upper member 11 and a rigid lower member 12. The rigid upper member 11 is more rigid than the compressible semi-rigid material 13. Furthermore, referring to FIGS. 1-4, it can be seen that in the deactivated state the body portion is disposed entirely within the sheath while in the activated state at least a portion of the body portion extends out of the sheath. In addition, the height of the housing portion (semi-rigid material 13) can decrease as the weapon transitions from the deactivated state to the activated state. For example, in the activated state shown in FIG. 3, the housing portion has a first height 38, and in the deactivated (uncompressed) state shown in FIG. 5, the housing portion has a second height 58, where the first height 38 is less than the second height 58. In order for the blades 14, 15, and 16 to be exposed when the weapon is in the activated state, in the activated state the first height 38 of the housing portion is substantially smaller than the first length 53 of the body portion 51. Furthermore, as shown in FIGS. 1-5, it can be understood that the upper portion 52 extends entirely out of the sheath in the activated state and the upper portion 52 is substantially enclosed within or surrounded by the rigid upper member 11 in the deactivated state. As described herein, the weapon is configured to transition from the deactivated state to the activated state when a compressive force is applied to the rigid upper member 11 and the rigid lower member 12, and to elastically return to the deactivated state when the compressive force is removed.

Referring to FIG. 1, the weapon's handle/sheath comprises a rigid upper member 11, and a rigid lower member 12, interconnected together by flexible compressible spring means such as semi-rigid material 13. This material may be foam, sponge, rubber or foam plastic material, or other compressible material that is flexible and has sufficient resistance to expand when not in use. One or more of a series of blades 14, 15, and 16 are spaced equidistant apart by the width of the human finger, and fixedly attached to the rigid lower member 12, or aligned slots in lower member FIGS. 5, 20, 21, and 22 and project in a perpendicular manner away from the rigid lower member 12. The blades 14, 15, and 16 are adapted (as shown in FIG. 5), to pass through a series of aligned slots in the flexible spring means 17, 18, and 19. The rigid upper member 11, also has aligned slots (FIG. 2) 23, 24, and 25, through which the blades 14, 15, and 16 are also adapted to pass through when the weapon is squeezed to expose the blades as shown in FIG. 2. The blades, 14, 15, and 16, project vertically away from the rigid lower member 12, and when not in use, the blades 14, 15, and 16 are enclosed within the retractable protective spring means 13, as shown in FIG. 1, and rigid upper member 11, for safe storage when the weapon is not activated.

In operation, when the hand is clenched as shown in FIG. 4, and the retractable protective means 13, squeezed, the blades 14, 15, and 16 pass through both the slots of the retractable protective means 17, 18, and 19 and slots of the rigid upper member 23, 24, and 25 as shown in FIG. 5, and between and beyond the users fingers. The weapon is then activated and ready for use.

This weapon has been designed to be small, portable, lightweight, and effective; resulting in a highly functional piece of equipment, as shown in FIGS. 1 through 4.

Although not intended or designed as a lethal weapon, the shape/configuration of the blade or blades 14, 15, and 16 may be varied, to provide a sharp claw-like blade, a flat sharp bladed edge, a serrated edge, a sharp conical point, or other cutting edge as desired. The materials used may also be varied including metals, plastics, springs, sponges or other materials for the blades and holder/sheath and other elements shown and described. The rigid upper member 11 may contain indolations or finger guides between the rigid upper member slots 23, 24, and 25 to prevent the blade or blades 14, 15, and 16 from coming in contact with the fingers when the weapon is squeezed. In addition, the rigid upper member, 11, may contain suitable external markers/guides (not shown in drawings) to inform the user to hold the weapon with the cutting edges of the blades 14, 15 and 16 pointed toward the attacker and away from the user.

The handheld weapon may also include (not shown in drawings) a strap means attached to the rigid upper portion, rigid lower portion or both, that fastens around the outside of the users hand and is expandable to fit most users hands. The strap means may be expandable material or two separate straps attachable by attachment means such as snaps, Velcro, or other materials. The strap means will prevent the user from inadvertently dropping the weapon during use.

Method of Manufacture

In the preferred embodiment both the rigid upper member and rigid lower member are molded using high impact plastic or other sufficiently rigid material to effectively perform as a defensive weapon. The rigid upper member and rigid lower are assembled together to be interfitted with one another for reciprocal movement of a blade or blades into and through openings in the flexible spring means and openings in the rigid upper member, and a sponge or other material with sufficient resistance to interconnect the rigid upper and rigid lower members, is attached to both the rigid upper member and rigid lower member with glue or other epoxy, and expandable to separate the rigid upper member from the rigid lower member and sheathe the blade when not in use.

Since these and many other changes may be made without departing from the spirit and scope of this invention, this invention should be considered as being limited only by the following claims.

What is claimed is:

1. A weapon comprising:

at least a first blade, the first blade including a body portion and an upper portion, wherein:

the body portion includes a first length, the upper portion includes a second length and the first length is greater than the second length, the body portion is bounded by four blunt outer surfaces including a forward surface, a rearward surface, a first side surface, and a second side surface, and the upper portion includes a blunt concave surface extending from the forward surface to an outermost tip portion;

a sheath including a flexible and compressible housing portion that extends between an upper member and a lower member, the upper member being substantially more rigid than the housing portion; and an activated state and a deactivated state, wherein the body portion is disposed entirely within the sheath in the deactivated state.

2. The weapon of claim 1, further comprising a second blade and a third blade.

3. The weapon of claim 2, wherein the first blade and the second blade are spaced apart by a first distance, the second blade and the third blade are spaced apart by a second distance, and wherein the first distance and the second distance are substantially similar.

4. The weapon of claim 1, wherein the body portion includes a rectangular cross-section across a horizontal plane.

5. The weapon of claim 1, wherein the forward surface of the first blade has a substantially rectangular shape.

6. The weapon of claim 1, wherein:

the forward surface of the first blade includes a first width, the concave surface includes a second width, and the first width is greater than the second width.

7. The weapon of claim 1, wherein the concave surface of the first blade tapers in width as it approaches the outermost tip portion.

8. The weapon of claim 1, wherein the outermost tip portion of the first blade comprises a substantially sharp end.

9. The weapon of claim 1, wherein the forward surface is substantially perpendicular to both the first side surface and the second side surface.

10. The weapon of claim 1, wherein the first blade extends outward from a slot in the upper member in the activated state.

11. The weapon of claim 2, wherein:

the first blade extends outward from a first slot in the upper member in the activated state, the second blade extends outward from a second slot in the upper member in the activated state, and the third blade extends outward from a third slot in the upper member in the activated state.

12. The weapon of claim 11, wherein a groove is formed in the upper member between the first slot and the second slot, the groove being configured to snugly receive a width of a human finger.

13. The weapon of claim 1, wherein the upper member comprises a high impact plastic.

14. The weapon of claim 2, wherein a material comprising the housing portion is selected from the group consisting of foam, sponge, rubber, and foam plastic.

15. The weapon of claim 1, wherein:

the housing portion has a first height in the activated state and a second height in the deactivated state, and the first height is substantially smaller than the second height.

16. The weapon of claim 15, wherein the first height of the housing portion is substantially smaller than the first length of the body portion of the first blade.

17. The weapon of claim 2, wherein the first blade is substantially parallel to the second blade.

18. The weapon of claim 1, wherein the upper portion of the first blade extends entirely out of the sheath in the activated state and the upper portion of the first blade is enclosed within the upper member in the deactivated state.

19. The weapon of claim 1, further comprising at least a first flexible spring disposed within and secured to the housing portion, the first flexible spring being configured to surround the body portion of the first blade when the weapon is in the deactivated state.

20. The weapon of claim 1, wherein:

the weapon is configured to transition from the deactivated state to the activated state when a compressive force is applied to the upper member and the lower member, and the weapon is configured to elastically return to the deactivated state when the compressive force is removed.

* * * * *